United States Patent [19]

Smith et al.

[11] Patent Number: 4,660,469

[45] Date of Patent: Apr. 28, 1987

[54] SHEAR SYSTEM

[75] Inventors: R. Paul Smith, Fairfax County, Va.; Thomas R. Betsinger, LaCrosse County, Wis.; Kathy T. Smith, Fairfax County, Va.

[73] Assignee: T.W. & Judson Shear Company, Inc., Beaver Heights, Md.

[21] Appl. No.: 856,180

[22] Filed: Apr. 28, 1986

[51] Int. Cl.[4] ..... B30B 9/32

[52] U.S. Cl. ..... 100/95; 83/923; 100/215; 100/244; 100/269 R; 193/2 R

[58] Field of Search ..... 100/215, 232, 39, 42, 100/233, 269 R, 95, 98 R, 94, 244; 83/279, 417, 923; 198/533, 535; 193/2 R, 17

[56] References Cited

U.S. PATENT DOCUMENTS

| | | | |
|---|---|---|---|
| 1,096,398 | 5/1914 | Sheppard . | |
| 1,121,571 | 12/1914 | Sheppard . | |
| 1,257,558 | 2/1918 | Webb . | |
| 2,360,487 | 10/1944 | Fullerton . | |
| 3,101,045 | 8/1963 | Van Endert | 100/233 |
| 3,141,401 | 7/1964 | Lindemann et al. . | |
| 3,273,493 | 9/1966 | Smiltneek . | |
| 3,283,697 | 11/1966 | Findlay . | |
| 3,563,163 | 2/1971 | Schoenauer . | |
| 3,564,994 | 2/1971 | Mosley | 100/233 |
| 3,610,138 | 10/1971 | Galter | 100/95 X |
| 3,945,315 | 3/1976 | Dahlem et al. . | |
| 4,018,169 | 4/1977 | Schmalz | 100/98 R |
| 4,086,850 | 5/1978 | Becker | 100/42 |
| 4,103,610 | 8/1978 | Vezzani . | |
| 4,149,547 | 4/1979 | Komossa | 198/533 X |
| 4,202,263 | 5/1980 | Schulte . | |
| 4,230,037 | 10/1980 | Schmalz | 100/95 |
| 4,253,388 | 3/1981 | Vezzani . | |
| 4,382,406 | 5/1983 | Vezzani | 100/98 R |
| 4,552,062 | 11/1985 | Vezzani | 100/95 |

*Primary Examiner*—Billy J. Wilhite

*Attorney, Agent, or Firm*—Dickstein, Shapiro & Morin

[57] ABSTRACT

A shear system for processing scrap is provided that includes guiding and catching walls for enhancing the loading of large items into the shear system. A tiltable hopper is provided with an open rear so that very large and long scrap items may be processed. The hopper is tiltable so that scrap items may be loaded with relatively smaller apparatus. The system operates to precrush the scrap material taking advantage of leverage yielded by using pivoting wing and flap crushing surfaces. Crushing forces are essentially relieved prior to shearing to decrease the likelihood of jamming of the shear head. The system is modular and may be shipped to and erected in remote locations where electric power for operating the system is not available. The system includes an enclosed and protected area for the power plant and control station.

14 Claims, 34 Drawing Figures

SHEAR SYSTEM

BACKGROUND

The present invention relates generally to the processing of scrap metal and more particularly to a system for crushing and shearing scrap metal.

Scrap metal may be recycled if it can be reduced to a size that may be easily handled, shipped and further processed. Typically, large scrap metal items such as trucks, beams, fabricated items, vessels and the like are first crushed to a compact form and then cut into chunks or blocks that are of a size that may be economically handled and processed. The crushing of the scrap requires a significant investment in crushing apparatus as well as handling apparatus, such as cranes and the like, for feeding the scrap to the crushing apparatus. Moreover, significant energy is consumed in crushing and shearing scrap to the desired size and shape.

A variety of techniques and apparatus exist for crushing scrap. Typically, scrap is positioned between two walls, at least one of which is movable and hydraulic cylinders are utilized to move the wall or walls to crush the scrap. Some known apparatus crush in more than one direction, either simultaneously or in sequence. Some crush in concurrent directions. Some known apparatus feed scrap to the crushing area and to the cutting area by an additional movable wall or ram. Others feed down an inclined plane by gravity.

A number of prior U.S. patents disclose systems that crush in a direction perpendicular to the scrap feed direction. Such reference include Schoenauer, U.S. Pat. No. 3,563,163; Galter, U.S. Pat. No. 3,610,138; Dahlem et al, U.S. Pat. No. 3,945,315; Becker et al, U.S. Pat. No. 4,086,850; Vezzani, U.S. Pat. No. 4,253,388; and Vezzani, U.S. Pat. No. 4,382,406. Of these patents Galter, Vezzani, '388 and Vezzani '406 disclose the use of a gathering action.

A number of known systems use a movable wall for crushing that moves in an arc. Schoenauer, Galter, Dahlem et al and Becker et al, mentioned above as well as Smiltneek, U.S. Pat. No. 3,273,493 and Van Endert, U.S. Pat. No. 3,101,045 and Schulte, U.S. Pat. No. 4,202,263 discloses the use of a pivoting wall. Of these, Smiltneek and Galter have pivot axes near the shear head while the other references have pivot axes remote from the shear head.

Galter discloses an apparatus that has both a gathering wall 3 and a non-gathering pivoting wall 4. Dahlem et al discloses a device having a pivoting wall 22 in conjunction with a laterally moving wall 17 and a laterally moving ram 19. Wall 22 and ram 19 act along the same extent of the crushing apparatus between the shear head and the feeding ram 11 as can be seen in FIG. 2.

Smiltneek discloses a crushing mechanism that takes advantage of the leverage of a stationary pivot axis on the non-gathering crushing wall at the end near the shear head.

A number of these patents also disclose systems to perform a crushing step with and in the same direction as the shearing action. Dahlem et al and Vezzani '388 and '406, for example, discloses such systems.

Known shear systems utilize exposed power plants and hydraulic pumps. Such systems are susceptible to damage due to impact from scrap or machinery and due to weather. Such systems must utilize auxiliary buildings in order to house and protect the pumps and plants.

Crushing apparatus capable of handling the largest scrap items, such as railroad cars, are rare. Typically, such larger scrap items are cut with torches into pieces small enough to be processed through existing crushing and cutting systems. Such cutting is highly labor intensive and thus often economically unfeasible. As a result, large scrap items often are not reprocessed and go to waste.

Large scrap items cannot easily be loaded into known shear systems. Such large items are often off-balanced and must be swung and maneuvered by crane into position which takes considerable time. This loading time may limit the production of the shear system. Tiltable staging tables have been used for feeding scrap shredders. These tables are incapable of handling large items and could not solve the loading problems confronted with large scrap items.

Often large scrap exists in locations remote from processing facilities. Known shear systems use hydraulic cylinders operated with electric hydraulic fluid pumps. Some remote locations do not have electric power available at all or electric power lines are insufficient to handle the power consumption of crushing and shearing apparatus.

There is a need for a shear system capable of handling large pieces of scrap at remote as well as close in locations. Known systems require external power sources and auxiliary buildings to house power units, hydraulic pumps and control units. There are no known shear systems that are self-contained, that may be erected at a location having no power source and that are capable of handling scrap items of large sizes without first cutting such large scrap into pieces prior to processing.

SUMMARY

The present invention alleviates to a great extent the shortcomings of the prior systems by providing a shear system having a self-contained power plant, a tiltable bed allowing loading of a scrap of long lengths at relatively low heights, utilizing gravity feed and crushing walls that are pivoted near the shear head and driven by hydraulic cylinders to utilize leverage to achieve crushing force greater than the forces of the hydraulic cylinder. Guiding walls are provided to speed up loading of large scrap items.

DETAILED DESCRIPTION

Figure 1:
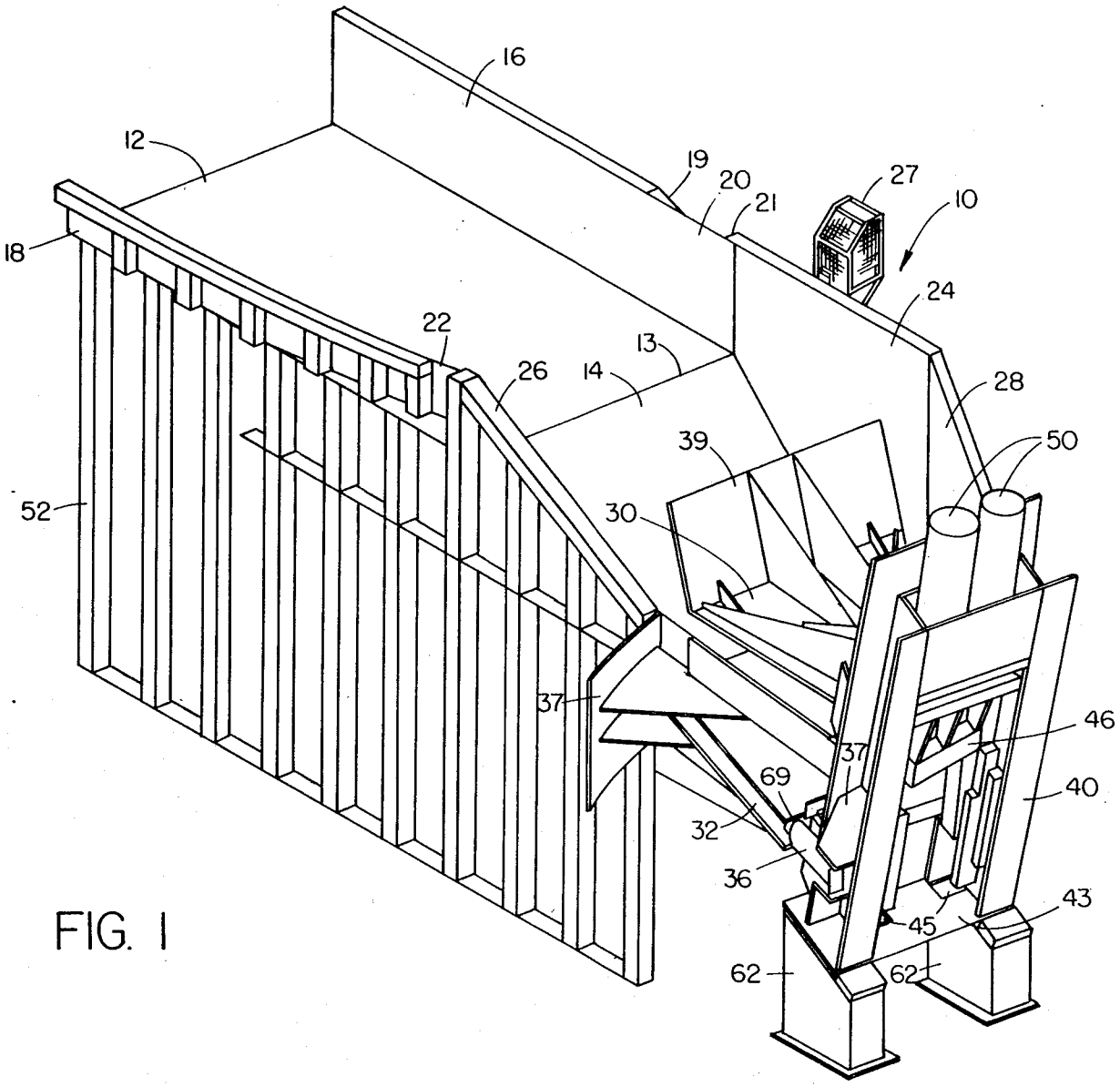
FIG. 1 is a perspective view of a shear system according to a preferred embodiment of the present invention.

Refer to FIG. 1, there being shown a perspective view of a shear system, generally designated by reference numeral 10, according to a preferred embodiment of the present invention. Shear system 10 includes a tiltable hopper 12 onto which scrap is loaded. Preferably, scrap is loaded from either the right (or loading) side or the back of the shear system. Tiltable hopper 12 has a hopper catching sidewall 16 along the left side of its base and a hopper loading sidewall 18 on the loading side. Wall 18 is relatively short to allow easy loading of the hopper as well as to inhibit spilling of scrap metal. Wall 16 is relatively high so that the loaded material will be caught and guided so as to not fall off the left side of the shear system particularly during loading. The relative height of wall 18 to wall 16 allows a crane operator to swing scrap over wall 18 to be caught and guided by wall 16. This feature enhances loading ease and speed.

Chute 14 is inclined so that scrap fed thereon, either directly or first onto hopper 12 and then, upon the raising of hopper 12, fed by gravity onto chute 14, will be fed by gravity down chute 14 towards the crushing and shearing areas of the shear system. In this way, hopper 12 acts as an extension of chute 14 and enhances the capability of the system to handle long scrap items while maintaining a relatively low hopper height for loading. Absent the tilt hopper feature, the chute would necessarily extend much higher into the air in order to handle comparable length scrap items. Hopper 12 is open at the rear-end. This enables even longer items to be processed as they may protrude from the open rear of hopper 12. Hopper 12 may be held in the raised position as long as necessary during the processing of the scrap items. Hopper 12 also provides a staging area for holding loaded scrap prior to feeding and in this manner provides a means for regulating the feeding rates to the shear. If too much scrap is loaded into the crushing area the chances of over charging and stalling of the shear head is increased due to the excess thickness of the material to be sheared.

Chute catching sidewall 24 extends along the left edge of chute 14. Chute loading wall 26 extends along the loading side of chute 14. The chute loading wall 26 is low so that scrap material may be loaded over the wall. The chute catching wall 24 is relatively high so as to catch scrap to guide it during the loading process and therefore to decrease the time required for loading. Once loaded, wall 24 ensures that the scrap will not fall out the left side of the shear system. The relative heights of walls 26 and 24 yield similar advantages as hopper walls 18 and 16.

In the crushing area, flap 30 is provided to crush scrap material from the top. Flap guide 39 is provided to help guide the advancing scrap into the crushing regions of the system and to inhibit scrap from falling onto the top of flap 30 and cylinder 38. The guiding function of flap guide 39 greatly eases loading of large scrap items, such as tanks, rail cars and trucks by cranes. The loading process can be time consuming and ultimately limit production of the system. The guide 39, catching walls 16 and 24 as well as other features of the invention, significantly increase the speed of loading.

The angle alpha that guide 39 forms with crushing face 76 of flap 30 is chosen so that upon loading of large scrap items with flap 30 in the raised position, scrap impacting on the guide 39 will be directed towards the crushing region which is beneath flap 30. With flap 30 in the raised position, guide 39 may tilt towards the rear (hopper end) of the shear system or it may tilt to the front depending upon the angle alpha chosen.

Wings 32 and 34 (FIG. 2) are provided to crush scrap material from the sides. Hydraulic cylinders 36 drive wings 32 and 34 at pivot joints 69 to effect a pivoting crushing action.

The preferred arrangement is to position the axis of rotation of the pivoting crushing wall of the wings close to the shear head. As the scrap moves through the crushing region of the system, it becomes denser as it approaches the shear head due to the crushing action of the apparatus. As the scrap becomes denser it requires greater force to further crush it. With a crushing wall that is pivoted near the shear plate, crushing forces near the shear head can be generated that are greater than the force exerted by the hydraulic cylinder moving the crushing wall. This is due to the leverage of the arrangement. In this manner, the crushing forces is greatest at the densest and narrowest point in the crushed scrap. The relative crushing force exerted on the scrap along the crushing surface matches to a certain extent the load, or resistance to crushing, presented by the scrap.

A shear and ram support structure 40 is mounted at the front of chute 14 and is supported by blocks 62. Hydraulic rams 50 drive the shear head 46 as described in greater detail below.

Figure 2:
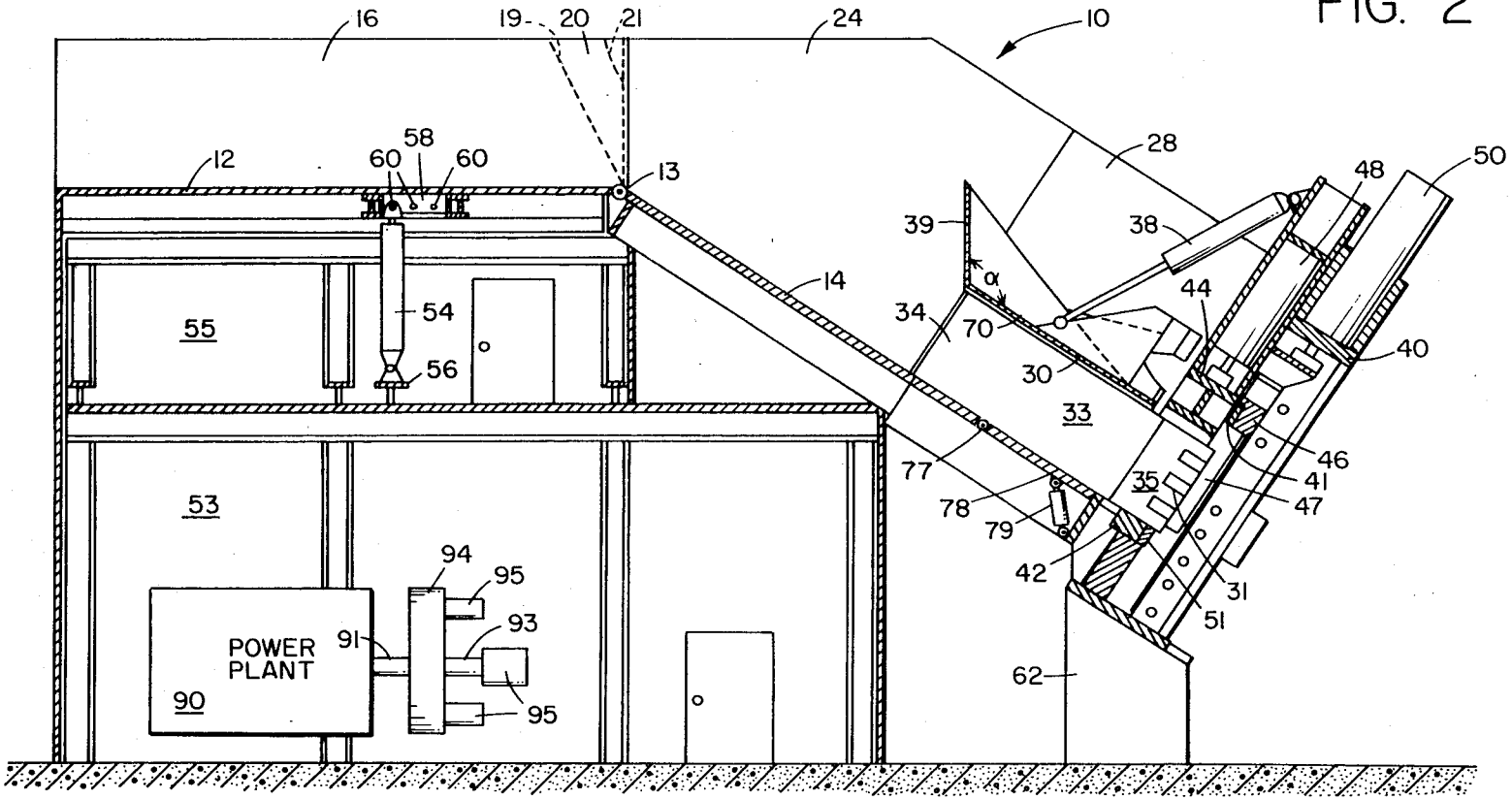
FIG. 2 is a view taken along section lines II—II of FIG. 17.

Note in FIG. 2 that wall 18 and wall 16 come short of extending all the way to walls 26 and 24 to provide clearance for the tilting action of hopper 12. Accordingly, shield plates 20 and 22 are provided to prevent scrap from exiting out of hopper 12. Shield plates 20 and 22 extend to some extent to overlap with wall 21 and 26 and move flush therewith upon tilting of hopper 12.

Hopper 12 is wider at the rear-end then at the front end and wall 18 is cantilevered to hang out to some extent from the right wall of the shear system. This tapering provides for easier movement of a scrap from hopper 12 into chute 14 when hopper 12 is raised. The cantilevered feature enables hopper 12 to be wider at the back to enhance loading speed and ease and still maintain a narrow profile of the shear system below the hopper to allow loading equipment close access.

A control station 27 (FIG. 1) is provided for an operator to oversee the system and operate the tiltable hopper 12, and the other features of the system. Alternatively, a video camera may be provided to view the crushing operation and control may be effected from within the housing of the system such as room 55 or room 53, or from elsewhere. Control station 27 includes necessary controls of the system power plant and hydraulics.

Figure 16:
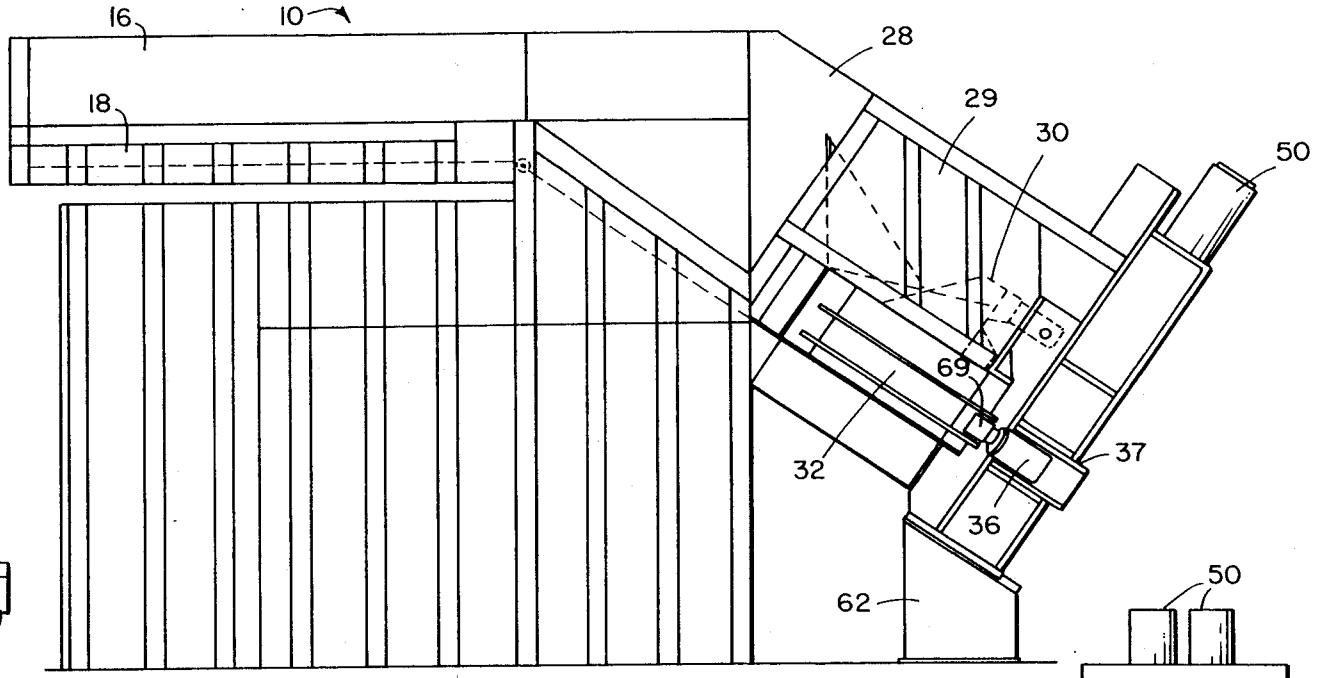
FIG. 16 is a side elevational view of the shear system as shown in FIG. 1.

Refer now to FIG. 16 wherein is shown an elevational view of the right side of the shear system 10. In this view it is shown that the height of wall 18 is less than the height of wall 16. Also shown in FIG. 16 is right wall 29, which is present to catch and guide scrap metal that may tend to fall out of the crushin region. Bracing structure such as bar 229 (shown in phantom in FIG. 1) is provided to strengthen and support walls 28 and 29.

Figure 17:
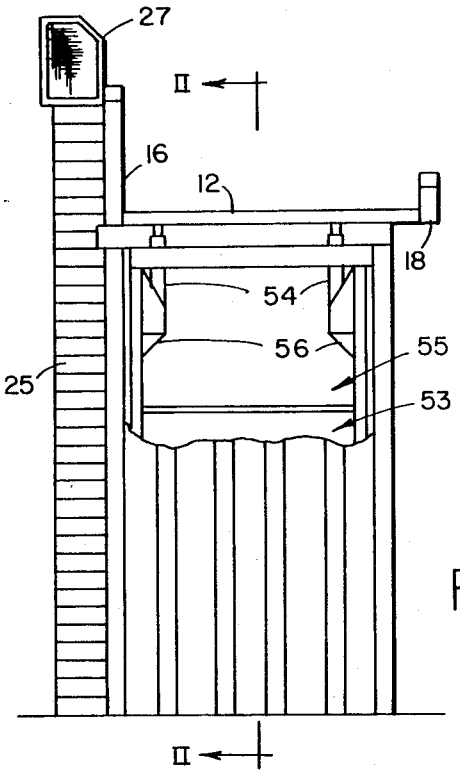
FIG. 17 is a rear elevational view of the system of FIG. 16.

Refer now to FIG. 17 wherein a rear elevation of the shear system of FIG. 16 is shown. Note that hydraulic cylinders 54 are attached to hopper 12 in position for raising and lowering hopper 12. Cylinders 54 are supported by sufficient support brackets shown as 56 in FIG. 17.

System 10 includes two rooms. First story room 53 houses the power plant and pumps and is enclosed from the weather. Second story room 55 houses the cylinder 54 and provides space for storage of parts or equipment or other uses where some greater degree of exposure to the weather is acceptable. Stairs 25 provide access to second story room 55 and control station 27.

Figure 18:
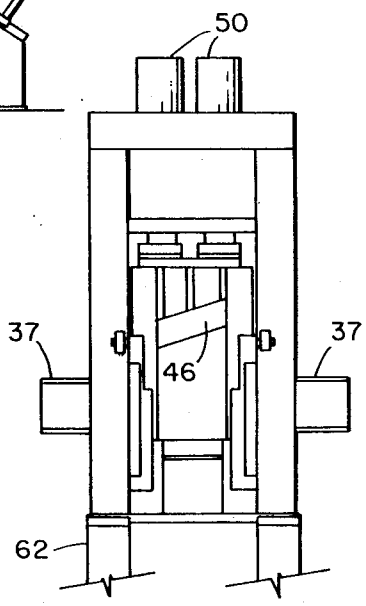
FIG. 18 is a front elevational view of the system of FIG. 16.

Refer now to FIG. 18 there being shown a front elevational view of the shear system of FIG. 16. Shear head 46 has an inclined cutting edge to improve cutting efficiency. Also wing cylinder supports 37 are shown. These supports are modular for shipping purposes and are fitted and attached to the structure 40 at the erection site. Two cylinders 50 are used for driving shear head 46. These cylinders are sized to generate a sufficient thrust to shear the desired thickness of scrap material. In this regard, all hydraulic cylinders are engineered for the extension desired and the power desired.

The placement of cylinders 36, driving wings 32 and 34, to drive the wings at pivot points 69, to achieve arcuate motion about the shear area, pivoting at hinges 31 results in a greater crushing force being applied to the scrap by surfaces 35 than if surfaces 35 were driven in a lateral motion, perpendicular to the shear direction. If the aforementioned lateral motion was utilized, the width of the shear system would be increased substantially. This increased width would decrease the versatility of the device in its placement and operation.

Refer now to FIG. 2, wherein is shown an elevational sectional view of the shear system of FIGS. 1 and 16. Hopper 12 is raised and lowered by the action of hydraulic cylinders 54 which are each pivotally connected at one end to a support 56 and pivotally connected at the other end to an adjustment plate 58 which is in turn attached to the underside of hopper 12. Note that adjustment plate 58 has a number of adjustment holes 60. The ends of hydraulic cylinders 54 can be attached to any of the adjustment holes 60. Connecting the hydraulic cylinders to different adjusting holes will result in a different maximum raised position of hopper 12. Connecting the hydraulic cylinders to holes 60 closer to hinge 13 will result in the hopper being raised to a steeper incline.

The angles of edges 19 and 21 (shown in phantom) of walls 16 and 24, respectively are chosen so that hopper 12 can be raised to the desired maximum inclination.

As shown in FIG. 2, crushing flap 30 is moved by hydraulic cylinder 38. Also shown is the face of crushing wing 34 which pivots at hinge 31. Wing 34 has a first face 35 near hinge 31 and a second face 33 extendiing from and meeting face 35 at an angle.

Ram 44 is driven by hydraulic cylinder 48 and provides a crushing force. Anvil 42 provides a solid base for acting opposite to the action of crushing ram 44.

Shearing head 46 is driven by hydraulic cylinders 50 and cooperates with anvil 42 to effect the shearing action. Head 46 and anvil 42 are provided with appropriate shear blades 41 and 51, respectively.

Shown schematically in FIG. 2 are the power plant and pump arrangement. A diesel power plant 90 with fuel supply is provided to drive a shaft 91 which, through multi-drive gear box arrangement 94, drives hydraulic pumps 95 and shaft 93. Another pump is driven off extension shaft 91. Alternatively, one or more additional multi-drive gear box mounted in series could be driven off extension shafts such as shaft 91. The hydraulic pumps generate pressure in hydraulic fluid lines (FIG. 32) which are selectively connected to the various cylinders in the shear system. Valving (FIG. 32) is also supplied to selectively raise and lower the various cylinders. Controls (not shown) are provided for controlling the power plant, the pumps and the various valve arrangements of the system.

Note that, in FIG. 2, the power plant 90 is shown under hopper 12 and is enclosed by the supporting sides of the shear system. The power plant unit is preferably a diesel unit for driving the hydraulic pumps. All hydraulic pumps are arranged to be driven off of a single shaft. The hydraulic control system is provided to selectively activate hydraulic cylinders for operating the crushing flap 30, crushing wings 32 and 34, ram 44, shear head 46 and tilt hopper 12. The pumps, controls and power plant unit are housed within the shear system and are protected from the elements. Moreover, these components are protected from impact damage from equipment or scrap handling.

Refer now to FIGS. 3 through 14 wherein the action of crushing flap 30, crushing wings 32 and 34, ram 44 and shear head 46 are described with reference to Table I.

TABLE I

Crushing and Shearing Process

| STEPS | HYDRAULICS MODES* Flap | Wings | Ram | Shear | Hopper | FIGS. |
|---|---|---|---|---|---|---|
| (a) Load scrap on hopper and/or chute | – | – | – | – | – | — |
| (b) Tilt hopper to gravity feed | – | – | – | – | + | 3,4 |
| (c) Crush with flap | + | – | – | – | + | 5,6 |
| (d) Withdraw flap to intermediate position | O | – | – | – | + | — |

TABLE I-continued

| Crushing and Shearing Process | | | | | | |
|---|---|---|---|---|---|---|
| | HYDRAULICS MODES* | | | | | |
| STEPS | Flap | Wings | Ram | Shear | Hopper | FIGS. |
| (e) Crush with wings | O | + | – | – | + | 7,8 |
| (f) Withdraw wings to intermediate position and flap to open position | – | O | – | – | + | — |
| (g) Crush with ram | – | O | + | – | + | 9,10 |
| (h) Release and withdraw ram | – | O | O | – | + | 11,12 |
| (i) Cut with shear head | – | O | O | + | + | 13,14 |

Figure 3:
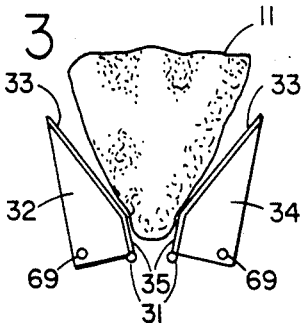
FIGS. 3–14 are schematic representations of various steps of operation of the shear system of FIG. 1.
Figure 4:
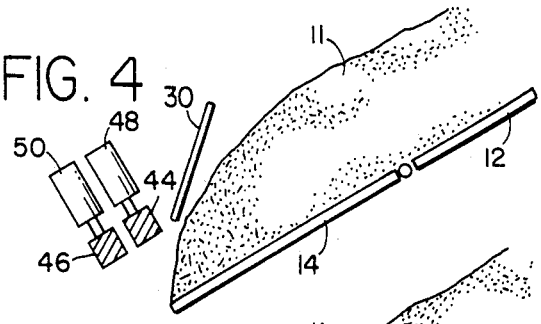

*Mode Key
+ Hydraulic Cylinder Extended
– Hydraulic Cylinder Withdrawn
O Hydraulic Cylinder Intermediate Position FIGS. 3 and 4 illustrate schematically the position of the various crushing mechanisms of the device and the shear head and tiltable hopper 12 at a time when a shearing operation process has been initiated. A lengthy piece of scrap 11 has been loaded into hopper 12 and/or chute 14, step (a) of Table I, and hopper 12 has been raised to feed scrap 11 by gravity into the position shown and to act as an extension of chute 14. This corresponds to step (b) of Table I. Wings 32 and 34 are positioned such that faces 35 diverge somewhat away from the shearing area. This presents an open area that allows a greater amount of scrap to enter between wings 32, 34. Alternatively wings 32 and 34 may be positioned differently, for example such that surfaces 35 are mutually parallel.

As described above, wings 32 and 34 pivot at hinges 31 and are driven at pivot joints 69 by hydraulic cylinders 36. In this manner, the surfaces of wings 32 and 34 move in an arc with the shearing area located at the center. Also, due to the leverage of the arrangement, a force greater than the force exerted by the hydraulic cylinder 36 is applied to surfaces 35 as well as to surfacess 33 up to a distance from hinge 31 that is equal to the respective distances between hinges 31 and pivot joints 69.

Note from FIG. 4, that flap 30 is in the raised position and that ram 44 and shear head 46 are also in the raised positions. Moreover, hopper 12 is in the raised position so that the lengthy scrap 11 is supported and fed therefrom by gravity to chute 14.

Figure 5:
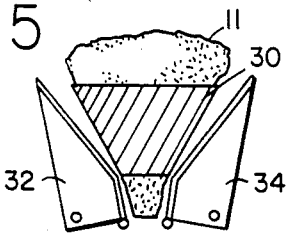
Figure 6:
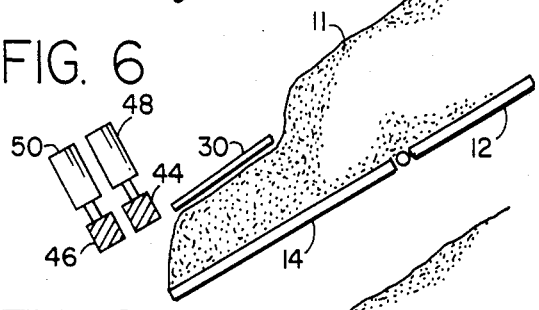

Refer now to FIGS. 5 and 6, wherein the first crushing step, corresponding to step (c) of Table I, is illustrated schematically. Wings 32 and 34 remain in the retracted positions. However, cylinder 38 has been extended to move flap 30 to crush scrap 11. This is represented schematically by the crushing area of flap 30 shown in FIG. 5. Additionally, if flap guide 39 is utilized it may exert some crushing force on scrap 11.

Figure 7:
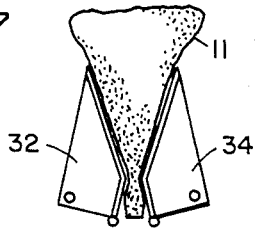
Figure 8:
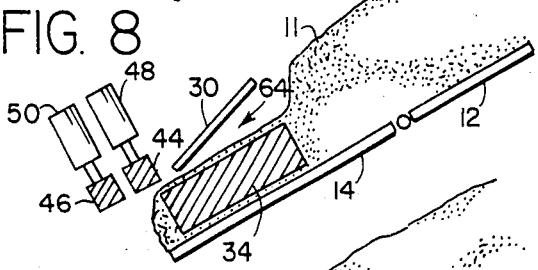

Refer now to FIGS. 7 and 8 wherein the next crushing step is shown. Note that, flap 30 has been raised (step (d) of Table I) to an intermediate or partial extended position to leave the space 64 between flap 30 and scrap material 11. In FIG. 8, the crushing region of wings 34 is shown schematically by a cross hatched area. FIG. 7, illustrates wings 32 and 34 in the extended crushing position. This corresponds to step (e) of Table I.

Figure 9:
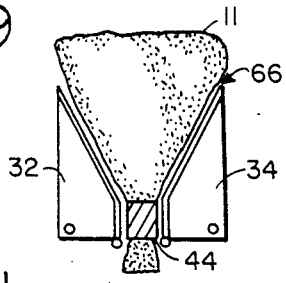
Figure 10:
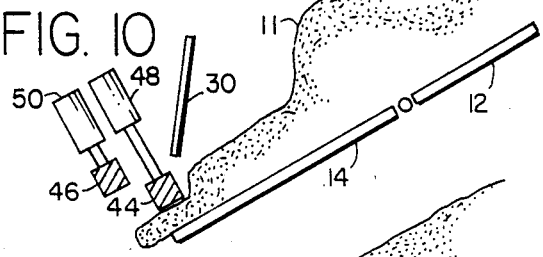
Figure 11:
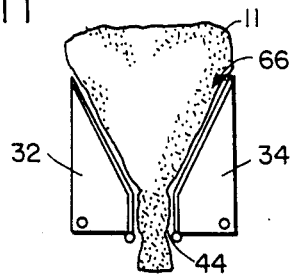

Refer now to FIGS. 9 and 10, wherein the next crushing step, step (g) of Table I, is shown. First, wings 32 and 34 are withdrawn to an intermediate position to leave spaces 66 between wings 32 and 34 and the scrap material 11 and flap 30 is raised to its withdrawn position, step (f) of Table I. After step (f) the scrap slides down chute 14 advancing to the position shown, coming to rest upon the faces of wings 32, 35. Ram 44 is now driven, step (g), by hydraulic cylinder 48 to crush the scrap material 11 to a size suitable for shearing. This is shown schematically in FIG. 9 by a cross hatched area showing the crushing area of ram 44.

Figure 12:
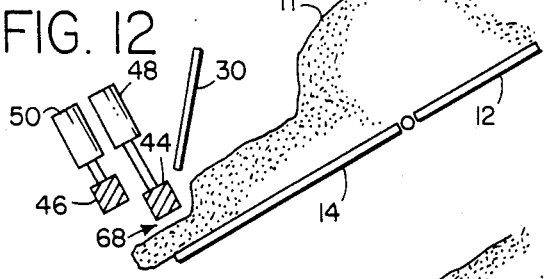

The next step in the process, step (h) of Table I, is to release and withdraw ram 44 to an intermediate position leaving space 68 between ram 44 and the scrap material 11 as shown in FIG. 12. Ram 44 does not act as a hold-down but, rather, is withdrawn from contact with the scrap material prior to activation of shear head 46 or prior to shearing force being applied by head 46. If ram 44 is not withdrawn but, rather, is in contact with and exerting a crushing force on the scrap material 11 at the same time that the shear head 46 is cutting the scrap material, there is a greater likelihood that shear head 46 may jam. If, on the other hand, the crushing force of ram 44 is decreased sufficiently or ram 44 is retracted somewhat from contact with the scrap material, as shear head 46 cuts, the scrap material is, to some extent, free to shift. By so enhancing the capability of the scrap to shift, the likelihood that shearing head 46 will jam and not cut through the scrap material is reduced significantly.

If the scrap does jam, movable panel 78 of chute 14 may be driven by cylinder 79 to pivot at hinge 77 to shake, move, shift or dislodge the jammed scrap as necessary. Panel 78 may extend over all or part of the width of chute 14.

Figure 13:
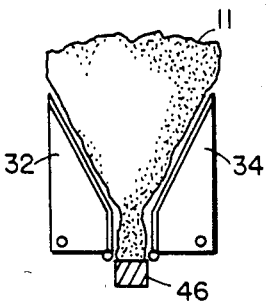
Figure 14:
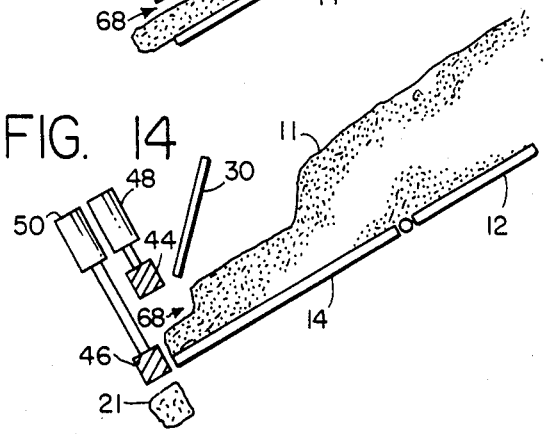

FIGS. 13 and 14, illustrate schematically the position of shear head 46 after it has sheared scrap material 11 according to step (i) of Table I. Sheared material 21 may be in the form of a single block or a number of pieces depending upon the material properties of scrap 11. The position of head 46 represented schematically in FIG. 11 by a cross hatched area. Preferably, during the shearing step, ram 44 is held at its intermediate position or is in the process of being raised.

Flap 30 is withdrawn to an intermediate position to provide clearance for wings 32 and 34 to crush as shown in FIG. 7 but is not withdrawn completely thus inhibiting scrap material 11 from escaping out the top of chute 14. As shown in FIG. 7, when wings 32 and 34 are at the maximum crushing position, surfaces 35 thereof are at a converging relationship in a direction away from the shear head. At this maximum crushing position, ram 44's crushing motion is blocked by the edges of surfaces 35. Therefore, wings 32 and 34 are withdrawn from crushing to an intermediate position as shown in FIGS. 9 and 10 to provide clearance for ram 44 to crush. Wings 32 and 34 are not retracted to a full extent as shown in FIGS. 3 and 5 but are only retracted to an intermediate position to help contain the scrap crushed by ram 44 and to act as guides for the motion of ram 44.

Table I and FIGS. 3–14 are directed to the embodiment shown. Alternate embodiments may utilize driving means other than hydraulic cylinders or may use cylinders arranged so that a crushing force is exerted on the scrap material when the cylinder is withdrawn rather than extended such as for example in the manner of Smiltneek.

Figure 15:
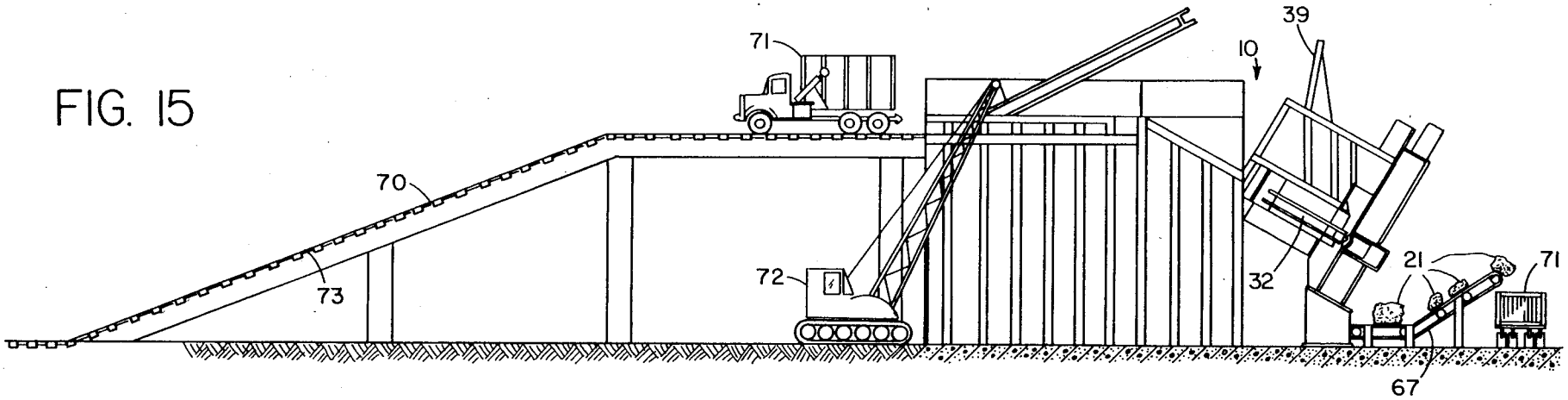
FIG. 15 is an elevational view showing the operation of the shear system in conjunction with a ramp for rear-end feeding.

Refer now to FIG. 15, wherein the shear system 10 is shown with a ramp 70 provided so that scrap 11 may be loaded by a truck or a train, utilizing track 73 built into ramp 70, or other vehicle directly onto hopper 12 from the rear thereof. Scrap railroad cars may be pushed along track 73 directly into hopper 12. Moreover, a conveyor belt may be used to load hopper 12.

Illustrated in FIG. 15 is an advantage of the tiltable hopper 12. Note that crane 72 can extend just high enough to load lengthy scrap 11 over wall 18 of hopper 12. If hopper 12 were not tiltable and therefore would be required to remain in its inclined position, which would be necessary to handle extremely large pieces of scrap, then a crane of much greater height would be required. Such cranes may not be available where scrap must be processed. Moreover, large cranes represent a significant investment of funds.

Convenient 67 is provided to load sheared scrap material 21 into transport vehicles such as truck 71 or rail cars.

Another feature of the shear system according to the present invention, is that it is prefabricated in modules that are no greater in dimension than standard acceptable shipping dimensions, typically 8 feet. These modules may be shipped anywhere by conventional shipping techniques using trucks or trains. Other known shear systems, due to their bulky design, have large components that must be shipped by special rail cars or otherwise. The use of such systems in remote areas is limited by these shipping considerations. Also, a number of known shear systems rely on electric power to operate the pumps for the hydraulic cylinders. The present shear system uses diesel power and operates all hydraulic cylinders off of a single shaft through a multi-drive gear box system. Thus, the shear system according to the present invention may be erected in remote locations where electric power is unavailable.

Figure 19:
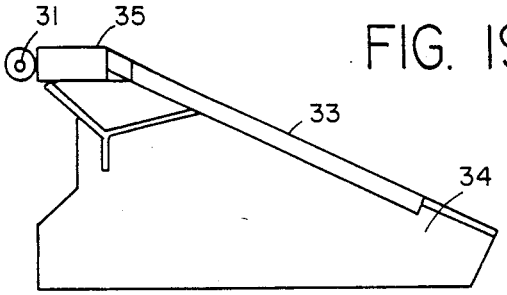
FIG. 19 is a plan view of wing 34 of the system of FIG. 1.
Figure 20:
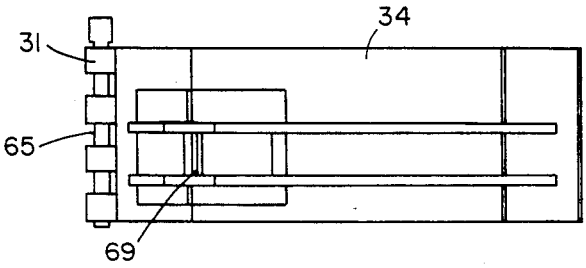
FIG. 20 is a side elevational view of the wing of FIG. 19.

Refer now to FIG. 19 wherein a plan view of the wing 34 of the shear system 10 of FIG. 1 is illustrated. Note the angle between faces 35 and 33 of wing 34. A side elevation of wing 34 is illustrated in FIG. 20. Pivot point 69 is shown as well as hinge pin 65.

Figure 22:
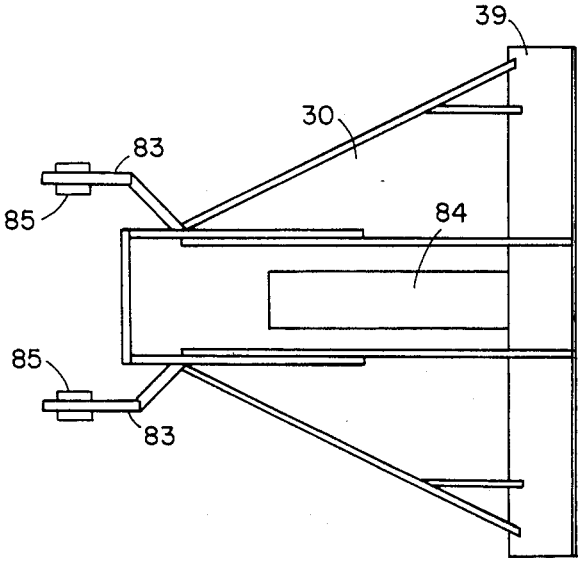
FIG. 22 is a plan view of an alternate embodiment of the flap 30 of the system of FIG. 1.
Figure 23:
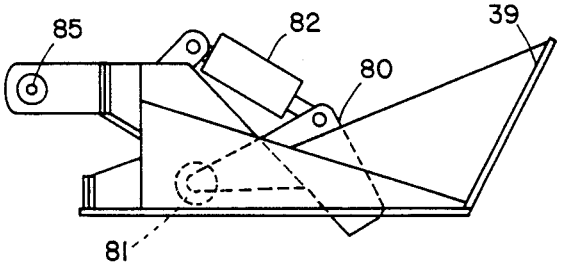
FIG. 23 is a side view of a flap similar construction to that shown in FIG. 22 including an optional braking bar apparatus.

FIGS. 22 and 23 illustrate an alternate embodiment of a flap 30 according to the present invention. In this alternate embodiment flap guide 39 is incorporated and a breaker bar 80 provides a concentrated compression to the scrap when necessary to initiate crushing of strong structures such as large cylindrical tanks and the like, which may resist to some extent the broad crushing force of flap 30. Breaker bar 80 is driven by hydraulic cylinder 82 and pivots about joint 81. FIG. 22 illustrates the aperture 84 that is provide in flap 30 for bar 80 to extend therethrough. Also illustrated in FIG. 22 are flap support arms 83 and pivot apertures 85.

Figure 34:
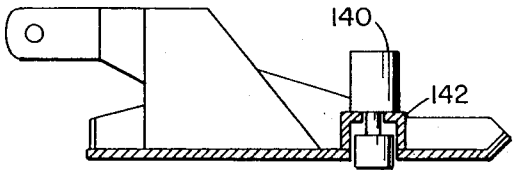
FIG. 34 is a sectional view of an alternate embodiment of a breaker bar arrangement.

FIG. 34 illustrates another alternate embodiment of a breaker bar arrangement. Cylinder 140 is mounted on a flap by structure 142 to drive breaker spike 141 to initiate crushing of strong scrap structure.

Figure 21:
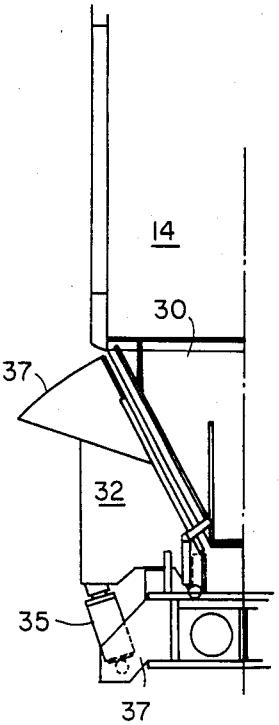
FIG. 21 is a partial plan view of the shear system of FIG. 1.

FIG. 21 illustrates the relative position of wing 32 and flap 30, each being in its intermediate position. Note that wing 32 is provided with a guard 37 for inhibiting the escape of scrap material from chute 14 when wing 32 is in a crushing position.

Figure 24:
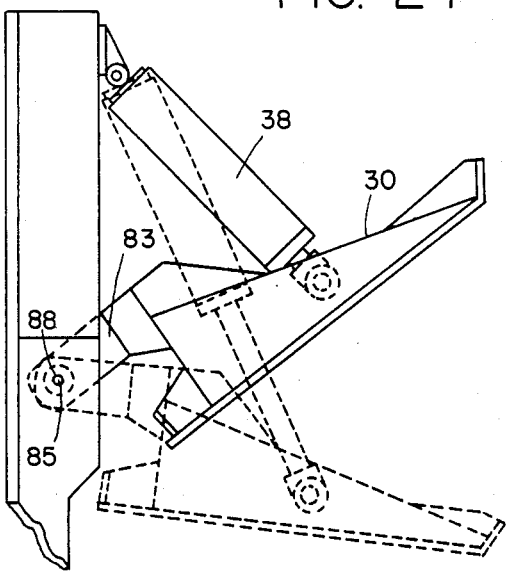
FIG. 24 is a schematic view showing the raised and lowered positions of flap 30 of FIG. 22.

FIG. 24 illustrates the operation of flap 30. Flap 30 is illustrated in its raised position with hydraulic cylinder 38. In phantom, the position of flap 30 is shown in its crushing position with hydraulic cylinder 38 extended.

Figure 25:
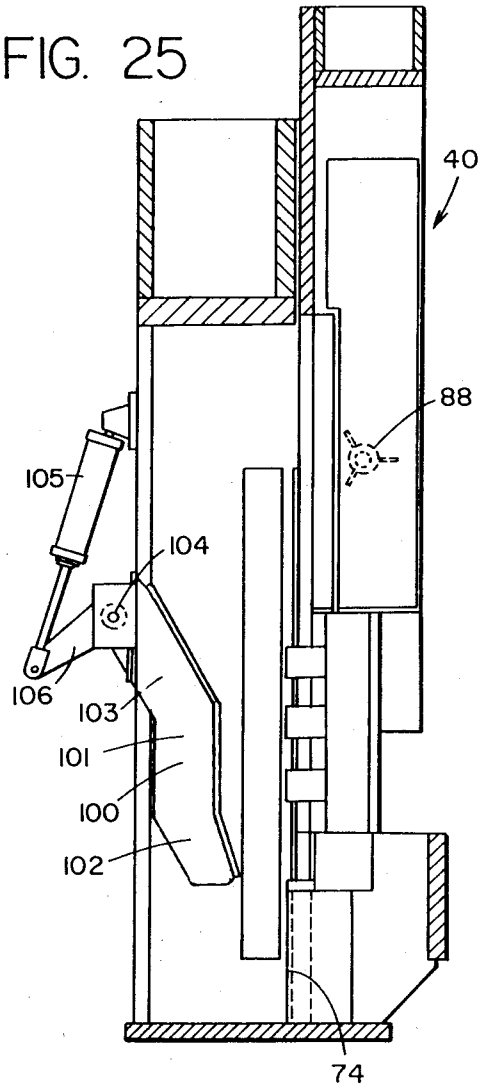
FIG. 25 is a partial cross sectional elevation view of the ram and shear head support structure and showing an optional sizing apparatus.

Refer now to FIG. 25 wherein a side sectional view is illustrated of the ram and shear head support structure 40. Primarily this view illustrates the use of back-stop 100 that is adjustably pivoted around pivot point 104 by the action of hydraulic cylinder 105 acting on arm 106. Back-stop 100 functions to stop the forward motion of the scrap material being fed by gravity. This effectively limits the length of the shear material 21. Note that back-stop 100 has an end portion 102, intermediate portion 101 and a pivot portion 103. These are arranged at angles to one another selected to that in any position that back-stop 100 may be placed, by the action of hydraulic cylinder 105, a surface is presented to the advancing scrap that is, on average, generally parallel to the face of that advancing scrap. The backstop is raised prior to shearing step (i), of Table I and may be raised concurrent with step (h) in operation of the system.

Figure 27:
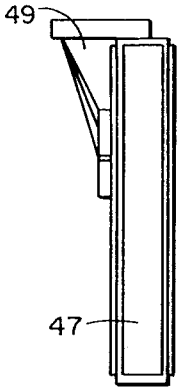
FIG. 27 is a left side elevational view of the shear of FIG. 26.
Figure 26:
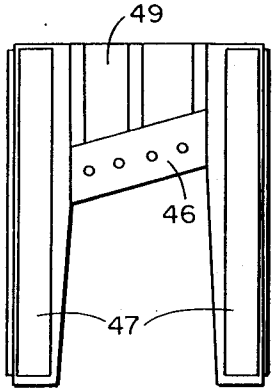
FIG. 26 is a front elevational view of the shear head.

Refer now to FIGS. 26 and 27 wherein the shear head of the present invention is illustrated. Shear head 46 includes a shear body 49 and two extending shear legs 47. Legs 47 cooperate with provided structure of support frame 40 for guiding shear head 46 in its motion. Apertures 45 are provided in a deflector plate 43 for accepting legs 47. Plate 43 (FIG. 29) is provided for deflecting the sheared scrap material 21 and for providing strengthening and support to the structure 40.

Figure 28:
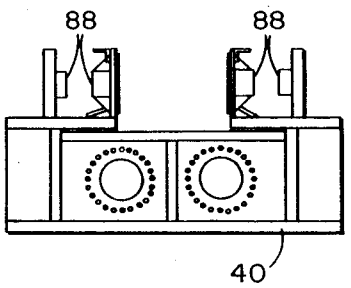
FIG. 28 is a plan view of the support structure for the ram and shear head.
Figure 29:
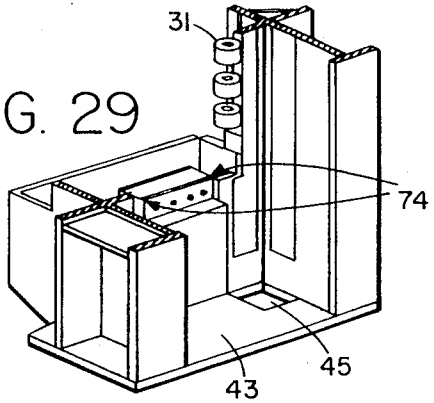
FIG. 29 is a partial perspective view of the support structure for the ram and shear head.

FIG. 28 illustrates the position of supports 88 for flap 30. FIG. 29 shows a partial sectional view of structure 40. Note that hinges 31 are positioned such that the hinge pins 65 extends down into provided apertures 74 of the support structure. This enhances the overall strength of the device. Also note from this view, that the hinges 31 are accessible for lubrication upon the raising of shear head 46 to a position such that legs 47 do not interfere with access.

Figure 30:
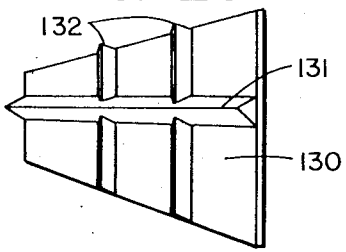
FIG. 30 is a perspective view of an alternate flap embodiment.
Figure 31:
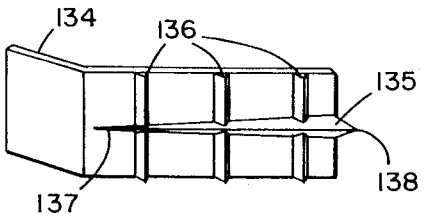
FIG. 31 is a perspective view of an alternate wing embodiment.

Refer now to FIGS. 30 and 31 whereing alternate embodiments of the flap and wings are shown. In these embodiments breaker bars and gripper bars are provided to enhance the crushing of material and to inhibit the backward movement of the material away from the shear area due to the radial arcuate motion of the crushing apparatus. Breaker bar 31 is provided on a flap 130 and is pointed to contact and initiate crushing of scrap material upon operation of flap 130. Gripper bars 132 are of a lower profile then breaker bar 131 and are provided to inhibit the motion of the scrap material during the crushing action.

Similarly, breaker bar 135 and gripping bars 136 are provided on wing 134. Note that breaker bar 135 is larger at its rearward end 138 and tapers to a smaller profile at its forward end 137. Such an arrangement tends to inhibit backward movement of scrap material as bar 135 initiates crushing in an arcuate motion. A bar with this tapered feature may also be provided on the flap such as flap 130.

Figure 32:
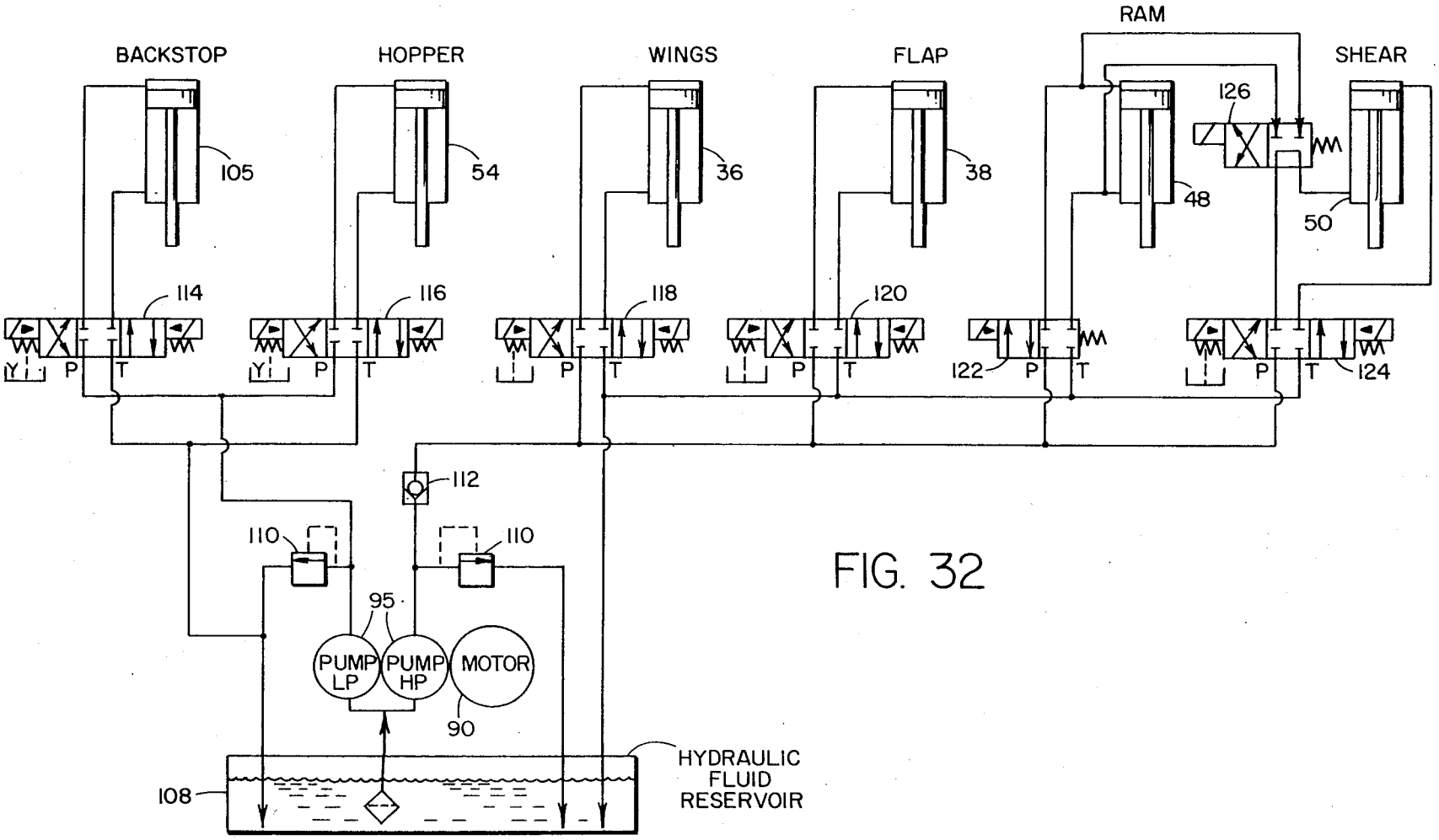
FIG. 32 is a schematic diagram of a hydraulic control system for the shear system of FIG. 1.

Refer now to FIG. 32, there being shown a schematic diagram of an hydraulic system for operating the shear system according to the present invention: The hydraulic cylinders 105, 54, 36, 38, 48 and 50 are shown schematically each with fluid conduits (unnumbered) provided for the movement of hydraulic fluid separately to the cap and rod sides of the cylinders. Cylinders 105 and 54 for the backstop and hopper, respectively, are connected through directional control valves 114 and 116, respectively, to the low pressure side of pump 95. Directional control valves 114 and 116 may be operated to control the extension and withdrawal of the backstop and hopper, respectively, to full or intermediate positions. A relief valve 110 is provided to recirculate any excess pumped hydraulic fluid to the tank or hydraulic fluid reservoir 108 such as when valves 114 and 116 are positioned to provide flow to cylinders 105 and/or 54. The high pressure side of the hydraulic circuit is also provided with a relief valve 110 as well as check valve 112.

Motor 90 drives pump 95 which also has a high pressure take off point for supplying hydraulic fluid to the balance of the system. The high pressure fluid is required for the crushing operations of the system. The low pressure side is sufficient for the non-crushing operations such as the backstop and hopper operation.

Directional control valves 114, 116, 118, 120, 122, 124 and 126 are of the type that have a pressure relief feature. This feature essentially equalizes the pressure on both sides of the cylinder by connecting all inlets to the valve together momentarily when the valve changes position. For example, once the backstop has been raised, via cylinder 105, the pressure on either side of the cylinder 105 is relieved so that a high pressure condition does not exist within the cylinder.

Pump 95 is illustrated as having a low pressue and high pressure portion. In actuality, a number of pumps may be ganged and the hydraulic fluid conduits may be manifolded to effect the high pressure and low pressure or high flow and low flow capabilities.

The crushing wings are operated by cylinders 36 and the crushing flap is operated by cylinder 38. The ram and shear are operated by cylinders 48 and 50, respectively. In the hydraulic system according to FIG. 32, when hydraulic cylinder 50 is extending the fluid from its rod side it is forced and directed into the rod side of hydraulic cylinder 48 to simultaneously raise the ram. This feature enables a significant amount of hydraulic fluid to be flowed from cylinder 50 to cylinder 48. By directing this fluid from cylinder 50 to drive cylinder 48 significant energy is saved over the alternative of drawing and directing hydraulic fluid from and to the reservoir, which may be many feet away, to withdraw cylinder 48 and extend cylinders 50.

The directional control valves are controlled such that when a predetermined pressure is reached in the cylinder they are returned to the unbiased position shown in the figures.

The operation of the ram and shear according to FIG. 32 is as follows:

Initially the ram and shear are in the raised position. Valve 122 is then activated so that hydraulic fluid flows into the cap end of cylinder 48 forcing the ram down to crush scrap. When the pressure builds to a predetermined level in the cap end of cylinder 48, valve 122 is returned to its position as shown in FIG. 32. Next, valves 124 and 126 are both activated such that they each move, schematically, to the right. Accordingly, hydraulic fluid is pumped into the cap ends of the shear cylinders 50. As shear cylinders 50 begin to extend, hydraulic fluid is forced from the rod end of cylinders 50 through valve 126 into the rod end of cylinder 48 thus raising the ram. Once the pressure within cylinder 48 reaches a predetermined level, the valve 126 returns to the position shown in FIG. 32. Hydraulic fluid from the rod end of shear cylinders 50 is now directed back to the tank.

This hydraulic arrangement not only saves fluid but automatically causes the ram to be raised whenever the shear begins its downward movement. This yields the above discussed advantage of relieving pressure from the crushed scrap material prior to shearng thus decreasing the likelihood of jamming of shear head 46. A number of other hydraulic arrangements may be utilized which will effect the releasing of significant crushing force by ram 44 prior to shearing to yield this advantage.

Figure 33:
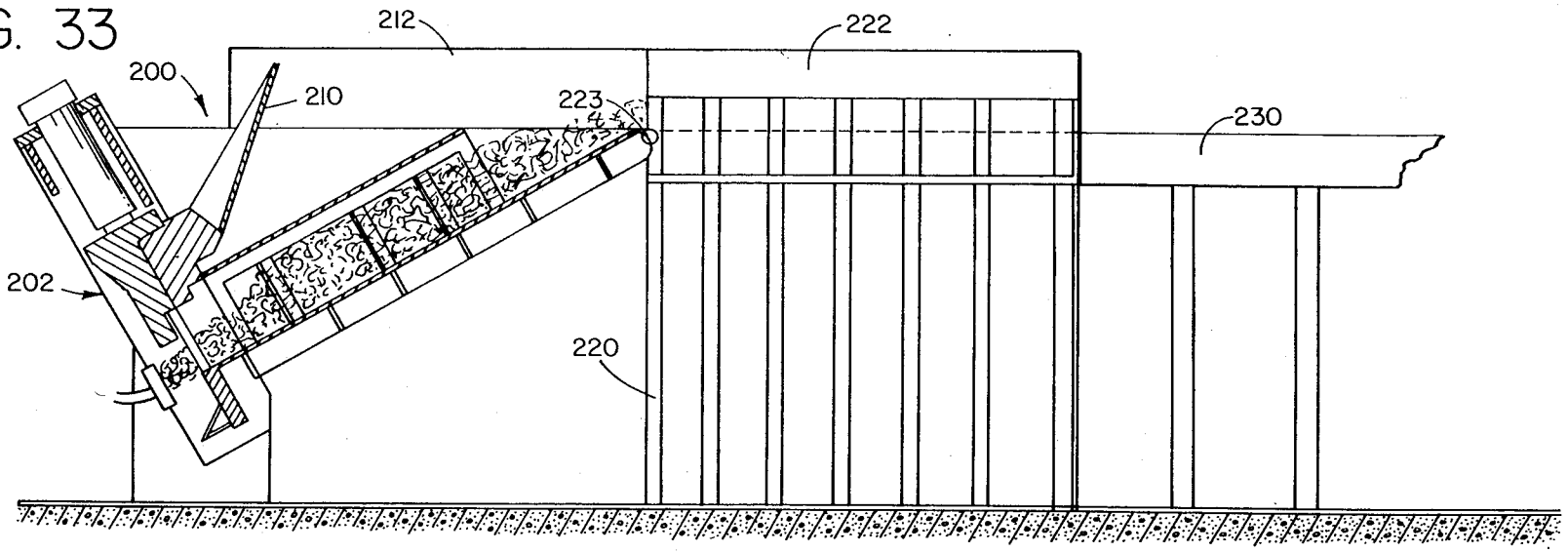
FIG. 33 is a partial cut-away elevational view of a known shearing apparatus modified to include a number of features of the present invention.

Refer now to FIG. 33 there being shown a known shear apparatus modified to include certain salient features of the present invention. The shear system generally designated by reference numeral 200 of FIG. 33 includes a shear apparatus 202 such as described in the aforementioned Vezzani patents. This apparatus has been modified to provide the guiding walls and catching walls of the present invention. Additionally, a tiltable hopper 222 and power unit enclosure 220 have been provided. Hopper 222 is provided with hinge 223. The add-on tilt unit 220 may be bolted or welded to the preexisting unit if necessary. Note that catching wall 222 and catching wall 212 are provided in conjunction with guide 210 for easing the loading of the apparatus as discussed above. Guide 210 is attached to the hold-down portion of the system. Guiding surface 210 is sized in all dimensions such that it can readily attach to the existing hold-down apparatus, but extends laterally to cover as much area as desired to aid in the loading process. Thus, guide 210 may extend across the entire lateral extent of the scrap chute of the known apparatus except as may be required to avoid contact with other moving parts or walls.

Also provided in FIG. 33 is the ramp feature 230 to enable loading by truck, rail or other means into the open rear of hopper 220.

A system 200 may be constructed by modifying an existing shearing unit 220 to enhance the loading capabilities and speed and improve the efficiency of operation of such existing unit.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed as new and desired to be secured by Letters Patent of the United States is:

1. A shear system for processing scrap comprising:

shearing means for shearing the scrap;

crushing means for crushing the scrap prior to shearing; and feeding means for supplying scrap to said crushing means and said shearing means, said feeding means including catching and guiding surface means for guiding the scrap during loading towards crushing and shearing areas of the system, said feeding means further including an inclined chute and tiltable hopper means for staging scrap and for providing an extension of such chute and having one end positioned to feed scrap to said chute.

2. A system as in claim 1, wherein said hopper means is hinged at its end adjacent said chute.

3. A system as in claim 2, wherein said hopper means includes a catching sidewall and a loading sidewall, said catching sidewall being higher than said loading sidewall.

4. A system as in claim 3, wherein said hopper means is open at its end away from said chute to allow lengthy scrap items to protrude therefrom.

5. A system as in claim 4, wherein said hopper means includes a hopper and a hydraulic cylinder connected at one end to said hopper at an adjustment plate having a plurality of cylinder connecting positions, each position corresponding to a different maximum inclination of said hopper.

6. A system as in claim 5, wherein said crushing means includes a pump means for pumping hydraulic fluid and said hopper means includes support means forming a protected area beneath said tiltable hopper means, said pump means being positioned within said protected area.

7. A system as in claim 6, wherein said crushing means includes flap means for crushing said scrap from the top with an arcuate motion.

8. A system as in claim 7, wherein said flap means includes a guide wall extending from the rear edge of said flap means, said guide wall being sized and positioned to aid the loading of scrap into said chute.

9. A system as in claim 8, wherein said hopper means is wider at its end away from said chute than its end adjacent said chute.

10. A system as in claim 9, wherein said hopper means loading sidewall is cantilevered over the hopper support means.

11. A system as in claim 10, wherein said flap means includes a crushing surface and breaker means for breaking scrap prior to contact by the flap crushing surface to decrease the crushing resistant strength of such scrap, said breaker means including a breaker bar extending from the front to the rear of the flap crushing surface.

12. A system as in claim 11, wherein said breaker bar is larger at its rear-end than at its front end.

13. A system as in claim 12, wherein said flap means includes laterally extending gripper means for preventing scrap from traveling in a rearward direction upon the arcuate motion of the crushing flap.

14. A system as in claim 1, wherein said chute includes a movable panel means for dislodging or shifting scrap material positioned to be sheared.

* * * * *

UNITED STATES PATENT AND TRADEMARK OFFICE

CERTIFICATE OF CORRECTION

PATENT NO. : 4,660,469

DATED : April 28, 1987

INVENTOR(S) : Smith et al.

It is certified that error appears in the above-identified patent and that said Letters Patent is hereby corrected as shown below:

Col. 5, line 20 change "crushin" to --crushing--.
Col. 8, line 16, change "35" to --34--.
Col. 9, line 27, change "Convenient" to --Conveyor--.
Col. 10, line 45, change "whereing" to --wherein--.
Col. 11, line 13, change "provide" to --prohibit--.
Col. 11, line 32, change "pressue " to --pressure--.

Signed and Sealed this

Eighth Day of March, 1988

*Attest:*

DONALD J. QUIGG

*Attesting Officer*

*Commissioner of Patents and Trademarks*